US005704628A

United States Patent [19]

Boehm et al.

[11] Patent Number: 5,704,628

[45] Date of Patent: Jan. 6, 1998

[54] DEVICE FOR STIFFENING A SKI

[75] Inventors: Alfred Boehm, Polling; Werner Messerschmidt, Garmisch-Partenkirchen, both of Germany

[73] Assignee: Marker Deutschland GmbH, Germany

[21] Appl. No.: 361,113

[22] Filed: Dec. 21, 1994

[30] Foreign Application Priority Data

Dec. 21, 1993 [DE] Germany ..... P 43 43 673.0

[51] Int. Cl.[6] ..... A63L 5/07

[52] U.S. Cl. ..... 280/602; 280/607

[58] Field of Search ..... 280/602, 607, 280/617, 618, 634

[56] References Cited

U.S. PATENT DOCUMENTS

| | | | |
|---|---|---|---|
| 4,221,400 | 9/1980 | Powers | 280/602 |
| 4,696,487 | 9/1987 | Girard | 280/602 |
| 4,896,895 | 1/1990 | Bettosini | 280/607 |
| 5,211,418 | 5/1993 | Scherübl | 280/607 |
| 5,269,555 | 12/1993 | Ruffinengo | 280/602 |
| 5,301,976 | 4/1994 | Stepanek et al. | 280/607 |
| 5,395,132 | 3/1995 | Abondance et al. | 280/607 |

FOREIGN PATENT DOCUMENTS

| | | |
|---|---|---|
| 0 223 976 B1 | of 0000 | European Pat. Off. . |
| 0 252 910 B1 | of 0000 | European Pat. Off. . |
| 0 492 658 A1 | of 0000 | European Pat. Off. . |
| 0 521 272 A1 | of 0000 | European Pat. Off. . |
| 28 33 393 A1 | of 0000 | Germany . |

*Primary Examiner*—Richard M. Camby
*Attorney, Agent, or Firm*—D. Peter Hochberg; Mark Kusner

[57] ABSTRACT

A device for providing a ski with additional stiffness with respect to bending in the transverse and longitudinal directions of the ski. The stiffening elements which provide the stiffening may be combined with ski bindings.

36 Claims, 3 Drawing Sheets

DEVICE FOR STIFFENING A SKI

FIELD OF THE INVENTION

The present invention relates generally to a device for stiffening a ski, preferably comprising of a carrier part or base part of a ski binding.

BACKGROUND OF THE INVENTION

EP 04 92 658 A1 discloses a carrier plate which is provided for the arrangement of ski bindings and of which one end is secured such that it is fixed to the ski and a displaceable end is guided so that it can move in the longitudinal direction of the ski. The displaceable end changes its spacing with respect to an abutment, which is fixed to the ski, when the ski bends upon skiing over bumps in the ground. Depending on the size of the spacing between the displaceable end of the carrier plate and the abutment and/or depending on the spring characteristic of a spring member arranged between the abutment and the displaceable end of the carrier plate, more or less high shearing forces are transmitted between the carrier plate and the abutment when at least one ski end bends, relative to the rest of the ski, in the upwards direction of the ski. In this manner, the rigidity of the ski with respect to bending deformations in the vertical longitudinal plane of the ski can be adjusted or changed. On soft pistes or in deep snow a pliable ski is usually desired, whereas on hard or icy pistes a flexurally rigid ski is generally advantageous.

EP 02 23 976 B1 discloses a ski which is secured with respect to torsion by a ring-bellows spring. In this arrangement, two ring-bellows springs are arranged in front of, and behind, the central region provided for receiving a ski boot. The springs counteract twisting of the ski ends relative to the central region, but are comparatively compliant with respect to other bending deformations of the ski.

It is known from EP 02 52 910 B1 to arrange an additional plate in the central region of a ski, on the upper side thereof. The plate passes in the longitudinal direction beyond the region provided for receiving the ski boot, and is connected to the ski in the manner of a torsion box to correspondingly increase the twist rigidity thereof.

U.S. Pat. No. 4,221,400 discloses a ski with adjustable rigidity. Arranged in the longitudinal direction within the body of the ski are twistable bars, the stressing of which can be changed by rotation. These bars act in a manner similar to the prestressing cables in prestressed concrete bridges.

SUMMARY OF THE INVENTION

It has been found that skis can undergo a pronounced bending in a horizontal longitudinal plane when the ends of the ski are bent vertically upwardly. The ski adopts a more or less arcuate form, and tends to move in an arcuate path in the snow.

It is an object of the present invention to provide new and improved arrangements for changing the rigidity of a ski in the longitudinal horizontal plane. This object is achieved according to preferred embodiments of the invention by a stiffening member which extends in the longitudinal direction of the ski and largely impedes bending movements of the ski in the horizontal longitudinal plane of the ski and generally allows bending movements of the ski in the vertical longitudinal plane of the ski. In other words, in some of the preferred embodiments of the invention,the ski resists bending in the lateral or transverse directions of the ski, but is less resistant to bending in the longitudinal direction of the ski.

The present invention is based upon the finding that a ski can undergo relatively pronounced bending deformations even in the lateral or horizontal longitudinal plane of the ski, in particular when the ski ends are bent in the upwards direction with respect to the central region of the ski. The above-mentioned bending deformations result in the ski adopting, in plan view, a more or less pronounced arcuate form and trying to move through a corresponding arcuate path. The present invention counteracts bending deformations of this type, and accordingly the skiing in a straight path is considerably improved and provides a feeling of skiing along a path free from unwanted lateral movements.

According to one preferred embodiment of the present invention, it is provided that the stiffening member is configured as a relatively rigid longitudinal member which cannot largely effect bending deformations of the ski in the vertical longitudinal plane thereof. As a result, the longitudinal member is not subjected to any lateral bending deformation when the ski slides over bumps or depressions in the ground, and the ski can be bent to a large extent in the vertical longitudinal plane of the ski. The longitudinal member only resists bending deformation when the ski is urged to bend in the horizontal longitudinal plane of the ski. The longitudinal member provides a comparatively high degree of resistance, with respect to horizontal bending stress, since mutually superimposed vertical and horizontal bending stresses are avoided in the longitudinal member.

It may expediently be provided, in design terms, that the longitudinal member includes a first part which is fixed to the ski and is anchored such that it cannot rotate about the vertical axis of the ski, and a second part which is spaced apart from the first part in the longitudinal direction, and is secured on the ski such that it can move in the longitudinal direction of the ski, but is relatively immovable in the transverse direction of the ski. The second part is preferably connected to the first part such that it can pivot about a transverse axis of the ski. In accordance with the foregoing arrangement of the longitudinal member, the ski will be largely responsive to bending movements in the vertical longitudinal plane of the ski, while bending movements of the ski in the horizontal longitudinal plane will be prevented or reduced.

In an alternative configuration of the present invention, an arrangement is provided in which both the bending rigidity of the ski in the vertical longitudinal plane of the ski and the bending rigidity of the ski in the horizontal longitudinal plane of the ski are effected.

In one preferred embodiment of the alternative configuration, the longitudinal member includes a movable part which can move in the longitudinal direction of the ski. The movable part is directed against an abutment part which is fixed to the ski, such that, at least in the event of pronounced upwards bending of a ski end, shearing forces can be transmitted between the movable part and the abutment part.

In a second preferred embodiment of the alternative configuration, two longitudinal members are arranged with mutually facing parts which can move in the longitudinal direction of the ski. The two longitudinal members also are arranged with parts which are remote from the mutually facing parts and cannot move in the longitudinal direction of the ski. These parts are connected to the ski such that they cannot rotate about the vertical axis of the ski, the intention being, at least in the event of pronounced upwards bending of a ski end, that shearing forces can be transmitted, in turn, between the mutually facing parts.

In yet another preferred embodiment, the longitudinal member can also be secured at three regions, which are spaced apart from one another in the longitudinal direction of the ski. The longitudinal member is relatively immovable in the transverse direction of the ski, and can be secured at least at two of the above-mentioned regions such that it is relatively movable in the longitudinal direction of the ski. In this embodiment, the longitudinal member may be configured, in a particularly simple manner, as a plate for securing or anchoring the ski binding.

In another embodiment, a longitudinally extending rigid member is movable in the longitudinal vertical plane relative to the ski of the ski flexes (or counterflexes). A control member fixed to the longitudinally extending member retains the bending of the ski in a longitudinal path by controlling the movement of generally opposed, parallel, longitudinal walls fixed relative to the ski and which move relative to the control member disposed between the walls as they move in the longitudinal direction. The vertical walls can be flexible and can be curved, to enable their movement relative to the control member in the transverse direction in response to transverse forces acting on the ski.

The control of the stiffness of the ski is accomplished by control means of the longitudinal member, which controls guide means operatively attached to the ski. The control means of the longitudinal member generally establishes the path of movement of the guide means of the ski.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein.

DETAILED DESCRIPTION OF THE PREFERRED EMBODIMENT

Figure 1:
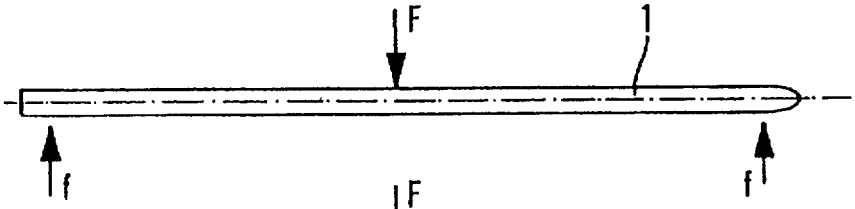
FIGS. 1 and 2 are top plan views of a ski having bending forces acting thereupon.

FIG. 1 is a top plan view of a lateral force F acting on a ski 1. Force F bears approximately over the entire length of ski 1 on the underlying surface in a central region of ski 1. This force is somewhat greater than the lateral guiding force of said central region of ski 1. In response to force F, counter-forces f become effective at the ends of ski 1, since the ends of ski 1 cannot readily follow a sideways movement of ski 1. Insofar as the forces F and f have relatively small values, ski 1 remains to the greatest extent rectilinear in plan view, as is represented in FIG. 1.

Figure 2:
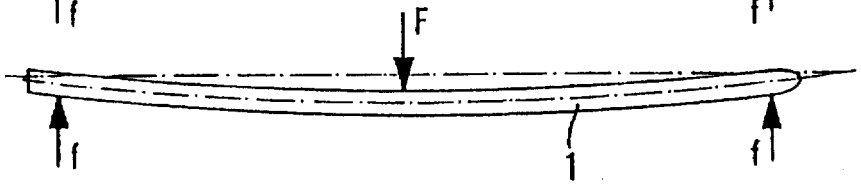

The forces F and f, as shown in FIG. 2, assume such large values that ski 1 bends considerably in the horizontal longitudinal plane of the ski. The bending in the horizontal longitudinal plane of the ski may be facilitated in that the ends of ski 1 are simultaneously bent upwards with respect to the plane of the drawing. This may occur, for example, when skiing through a depression in the ground.

It is notable that extensive bending of the ski in the horizontal longitudinal plane of the ski (see FIG. 2) can occur, since skis give the impression of having a high degree of rigidity with respect to such bending. Nevertheless, skiing tests have shown that the stability of a ski during skiing is improved considerably if measures are taken against bending of the type represented in FIG. 2.

Figure 3:
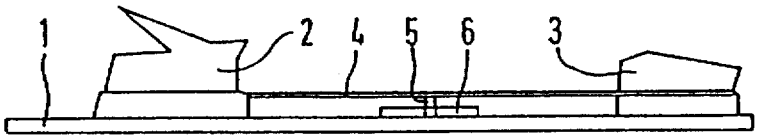
FIG. 3 is a side plan view of a portion of a ski configured with a first embodiment of the present invention.
Figure 4:
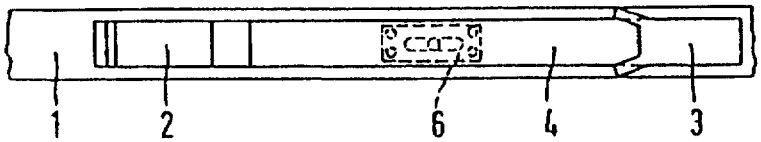
FIG. 4 is a top plan view of the arrangement shown in FIG. 3.
Figure 5:
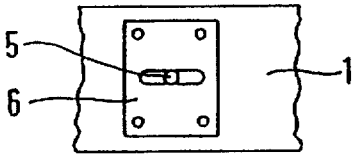
FIG. 5 is a top plan view of a component of the first embodiment of the present invention.

In the case of the embodiment shown in FIGS. 3–5, a ski binding is arranged in a basically conventional manner on a ski 1, said binding essentially comprising a heel part 2 and a front jaw 3 which secure a ski boot (not shown) in the heel region and in the toe region, respectively. Heel part 2 and front jaw 3 are connected to one another via a plate 4. Plate 4 is secured to the ski in the region of heel part 2, such that it is fixed to the ski, and is secured in the region of the front jaw 3, such that it retains a certain degree of movability in the longitudinal direction of the ski and is immovable in the transverse direction of the ski. The longitudinal movability ensures that ski 1, for example when skiing through depressions in the ground, can bend in its vertical longitudinal plane without plate 4 counteracting bending of this type. Only the front-jaw end of plate 4 is displaced in the longitudinal direction of the ski when the ski bends in this manner.

It will be appreciated that it is possible to permit the movable end of plate 4 (i.e., the front-jaw end) to interact with an abutment (not shown) which is fixed to the ski. The abutment is normally located at a specific spacing from the forward facing end of plate 4, in the longitudinal direction of the ski, or is coupled to plate 4 via a compression-spring member, which may be subjected to play. Accordingly, in the event of ski 1 bending in the vertical longitudinal plane of the ski, more or less high compressive forces can be transferred between the plate 4 and the abutment. These forces will counteract extreme bending of ski 1 when skiing through depressions in the ground.

An important aspect of the embodiment shown in FIGS. 3–5 is pin 5 and slotted-link part 6, best seen in FIG. 5. Pin 5 is a control means fixedly arranged on the underside of plate 4, in a central region between heel part 2 and front jaw 3, while slotted-link part 6 is a guide member fixed to the ski. Pin 5 guides or controls the movement of slotted-link part 6 by the relative displacement of the guide slit and part 6, and hence, ski 1. However, the ski cannot be displaced in the transverse direction of the pin 5. Consequently, the central region of the ski is stiffened to a considerable extent with respect to bending of the type represented in FIG. 2 (i.e., with respect to bending in the horizontal longitudinal plane of the ski).

Figure 6:
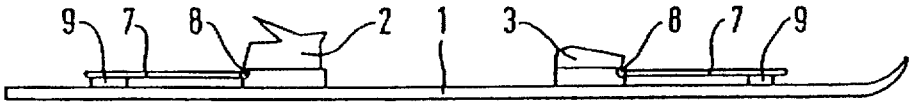
FIG. 6 is a side plan view of a ski configured with a second embodiment of the present invention.
Figure 7:
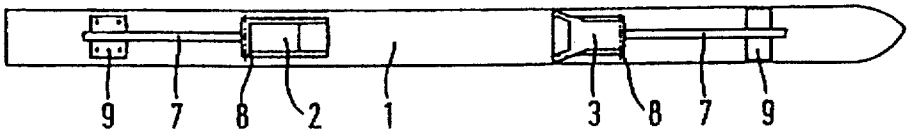
FIG. 7 is a top view of the arrangement shown in FIG. 6.

Referring now to FIGS. 6 and 7, there is shown a second preferred embodiment of the present invention. A rigid bar part 7 is arranged, in each case behind heel part 2 and in front of front jaw 3, such that it can pivot about a transverse axis of the ski by means of a joint or articulation 8. However, rigid bar part 7 cannot pivot with respect to the vertical axis of the ski. Each end of bar part 7 which is remote from the respective articulation 8 is secured on the ski 1, by means of a guide member 9, such that it can move in the longitudinal direction of the ski, but is relatively immovable in the transverse direction of the ski. Consequently, bending of the ends of the ski, relative to the central region of the ski, in the transverse direction of the ski, is impeded. It will be appreciated that the embodiment shown in FIGS. 6 and 7 allows control of the transverse bending to be effected independently for the toe end and the heel end of the ski.

Figure 8:
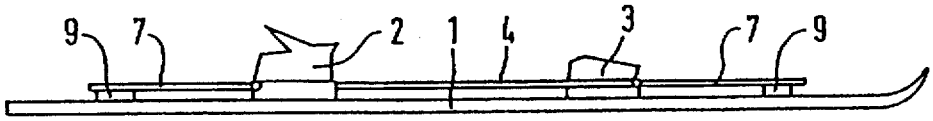
FIG. 8 is a side plan view of a ski configured with a modified version of the embodiment of the present invention shown in FIGS. 6 and 7.
Figure 9:
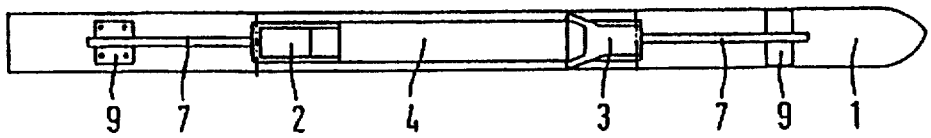
FIG. 9 is a top plan view of the arrangement shown in FIG. 8.

FIGS. 8 and 9 show a modified version of the embodiment shown in FIGS. 6 and 7. Heel part 2 and front jaw 3 are connected to one another via a plate 4 in order to further increase the bending rigidity of the ski in the transverse direction of the ski.

Figure 10:
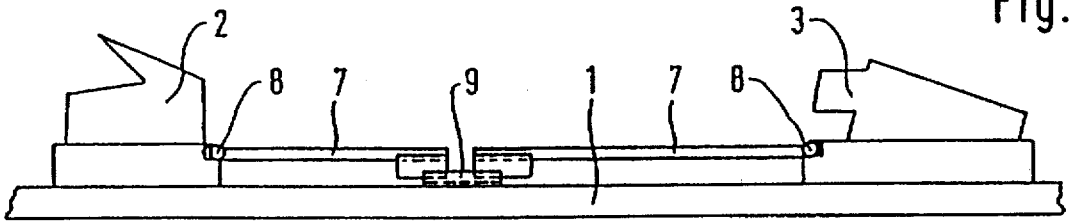
FIG. 10 is a side plan view of a ski configured with another embodiment of the present invention.

Referring now to FIG. 10, there is shown yet another embodiment of the present invention. Bar parts 7 are configured in a plate-like manner, and are arranged between heel part 2 and front jaw 3. Bar parts 7 are connected to heel part 2 and front jaw 3 via a joint or articulation 8, such that they can pivot about a transverse axis of the ski. The mutually facing free ends of bar parts 7 are guided in a ski-side guide member 9 such that they can move in the longitudinal direction of the ski, but are relatively immovable in the transverse direction of the ski. Consequently, bar parts 7 impede bending of ski 1 in the horizontal longitudinal plane of the ski, such as when one of the fastening regions of ski 1 for the heel part 2 and/or the front jaw 3 tries to rotate about a vertical axis of the ski relative to that portion of the ski 1 which is beneath guide member 9.

If the ends of the ski are bent upwards to a pronounced extent relative to the central region of the ski, as may be the case, for example, when skiing through depressions in the ground, bar parts 7 can butt against one another by their mutually facing free ends. As a result of the pronounced upward bending, pronounced shearing forces will occur between articulations 8 and/or the ski-side anchorings thereof. The shearing forces will counteract any further bending of the ski in the vertical longitudinal axis of the ski.

In the embodiment shown in FIG. 10, the mutually facing ends of bar parts 7 are normally spaced relatively far apart in the longitudinal direction of the ski. Correspondingly, the bending rigidity of the ski 1, which arises when the mutually facing free ends of bar parts 7 butt against one another, becomes effective only at a relatively late point in time, i.e., in the event of a very high degree of bending of the ski in its vertical longitudinal plane.

Alternatively, the spacing between bar parts 7 can also be dimensioned to be smaller or can be shortened by the insertion of intermediate pieces. Furthermore, a compression-spring member, such as in the form of an elastic cushion or a spring, may also be arranged between the mutually facing free ends of bar parts 7.

Figure 11:
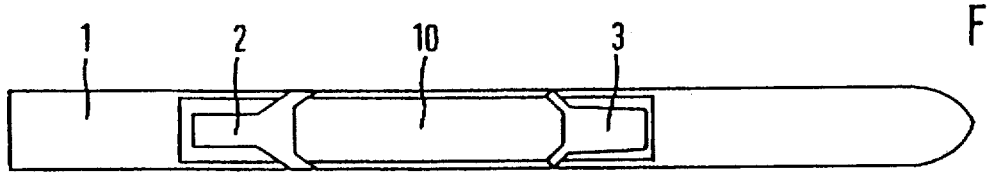
FIG. 11 is a top plan view of a ski configured with still another embodiment of the present invention.
Figure 12:
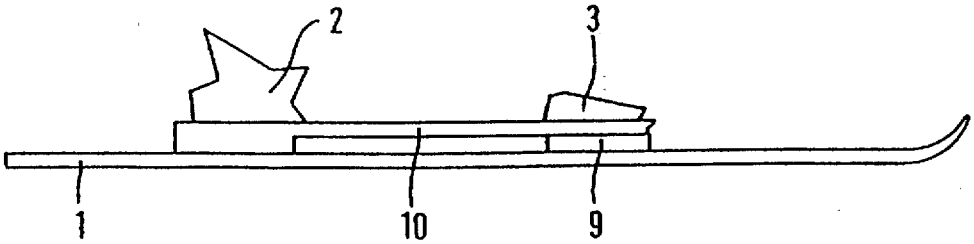
FIG. 12 is a side plan view of the arrangement shown in FIG. 11.

Referring now to FIGS. 11 and 12, there is shown still another embodiment of the present invention. In this embodiment, an essentially rigid plate 10, which receives heel part 2 and front jaw 3, is fastened to ski 1. In order to fasten plate 10 on ski 1, plate 10 has, beneath heel part 2, a shoulder-like thickened portion which is secured fixedly on ski 1 by means of screws or the like.

Plate 10 comprises a control means, which is otherwise spaced above the upper side of ski 1, is secured beneath front jaw 3 such that it can move in the longitudinal direction of the ski. However, plate 10 is secured on a guide member 9 attached to the ski, to make it relatively immovable in the transverse direction of ski 1. Consequently, plate 10 stiffens ski 1 with respect to bending in the horizontal longitudinal plane of the ski. Moreover, plate 10 also effects a certain degree of stiffening when the front end of ski 1 is bent in the upwards direction relative to the rest of the ski.

Referring now to FIGS. 13 to 18, there are shown various embodiments for guide member 9 shown in FIGS. 6 to 12.

Figure 13:
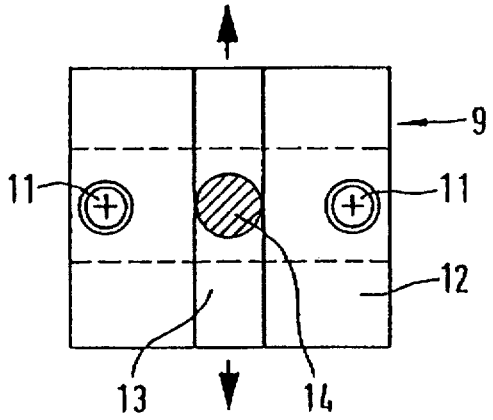
FIGS. 13 to 18 show various configurations for the guide members shown in FIGS. 6–12.

Referring now to FIG. 13, there is shown a top plan view of a first embodiment of guide member 9. Guide member 9 is a control means, comprised of a plate part 12 which is fastened on the ski 1 by means of screws 11 and has an upwardly open groove 13 which is aligned in the longitudinal direction of the ski and into which is located a control pin 14 or the like, which is a control means fixedly arranged on bar parts 7 (see FIGS. 6 to 10) or on plate 10 (see FIGS. 11 and 12).

Figure 14:
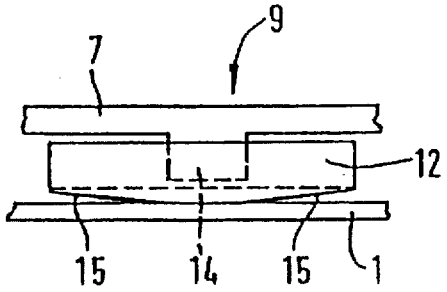

FIG. 14 shows a side plan view of the guide member 9 depicted in FIG. 13. The underside of plate part 12 may exhibit front and rear sloping surfaces 15 in order to permit ski 1 to bend, to the greatest extent unhindered, in the vertical longitudinal axis of the ski, in the region of plate part 12. However, within groove 13, control pin 14 or the like controls or impedes bending of the ski in the transverse direction.

Figure 15:
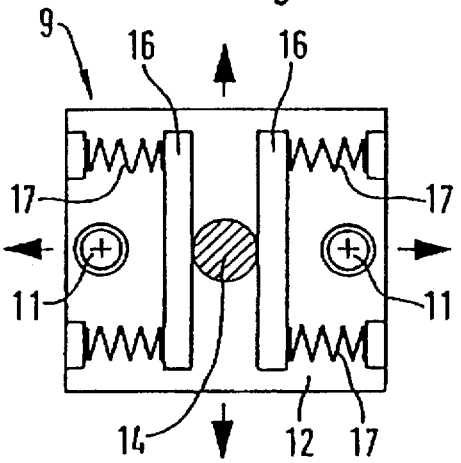

FIG. 15 illustrates another embodiment of guide member 9. In this embodiment groove 13 is replaced by guide mouldings 16 which may be arranged on plate part 12. Guide mouldings 16 form a groove-like channel which extends in the longitudinal direction of the ski and is intended for receiving control pin 14 or the like. Guide mouldings 16 may be resiliently secured in the transverse direction of the ski by means of springs 17 (e.g., helical steel springs), with the result that control pin 14 or the like may be able to control the yielding of mouldings 16 somewhat, against spring force, in the transverse direction of the ski. Springs 17 may, if appropriate, be arranged such that they are adjustable.

If ski 1 tries to bend in the sideways direction (i.e., in the horizontal longitudinal plane of the ski), control pin 14 responds with a force against the force of springs 17 in the sideways direction, with the result that the above-mentioned bending of the ski 1 is resiliently impeded.

Figure 16:
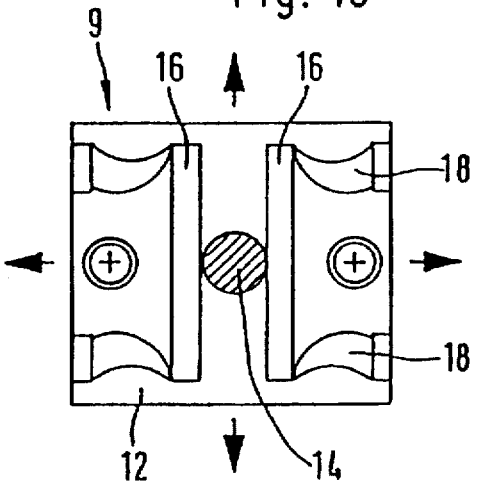

FIG. 16 shows a modified version of the guide member 9 shown in FIG. 15. In this modified version, plastic springs 18 are substituted for steel springs 17.

Figure 17:
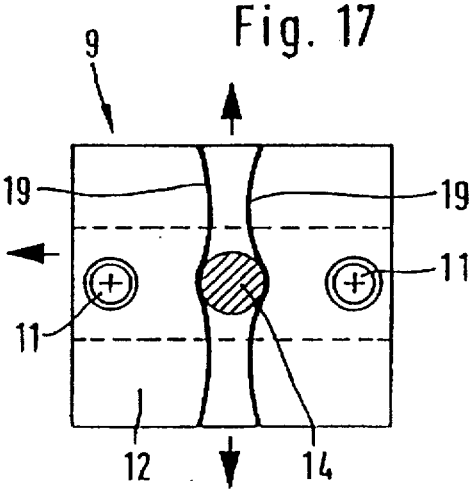

Referring now to FIG. 17, there is shown yet another embodiment of guide member 9. In this embodiment, there are arranged on plate part 12 two spring members 19, which leave between them a channel that extends in the longitudinal direction of the ski and is intended for receiving control pin 14. As a result of their elasticity, spring members 19 make it possible for control pin 14 received between them to respond with a counter-force to a force exerted by ski 1 and members 19 in the transverse direction, with the result that sideways bending of the ski 1 is countered by a resilient resistance.

Moreover, spring members 19 are shaped such that they form a narrowed portion in the longitudinal direction of the ski, in front of and behind control pin 14 located in a normal or central position. Each narrowed portion can be resiliently expanded by control pin 14. Accordingly, control pin 14 resists movement in the longitudinal direction of the ski against a certain resistance. When the ski bends in the vertical longitudinal plane of the ski and, correspondingly, the control pin 14 effects a movement of spring members 19 of guide member 9 relative to the ski in the longitudinal direction of the ski, control pin 14 engages spring members 19 and counteracts said bending movement with a friction resistance, which effects a corresponding damping.

A similar result can be obtained with guide mouldings 16 shown in FIGS. 15 and 16. In this respect, the mutually facing sides of mouldings 16 can be formed to correspond to the shape of spring members 19 shown in FIG. 17. Accordingly, guide mouldings 16, under the force of springs 17 and 18, are separated as they engage pin 14 upon movement in the longitudinal direction of the ski.

Figure 18:
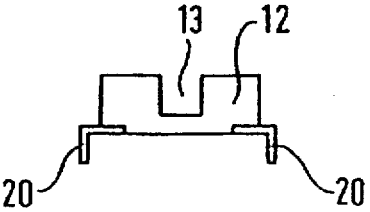

Plate parts 12 may also be fastened on ski 1 in a manner other than by the screws shown in FIGS. 13 and 15 to 17. In this respect, FIG. 18 shows a front plan view of plate part 12 having angular clamping webs 20. Clamping webs 20 may be arranged on plate part 12 to engage laterally around ski 1 from above.

The foregoing descriptions are specific embodiments of the present invention. It should be appreciated that these embodiments are described for purposes of illustration only and that numerous alterations and modifications may be practiced by those skilled in the art without departing from the spirit and scope of the invention. It is intended that all such modifications and alternations be included insofar as they come within the scope of the invention as claimed or the equivalents thereof.

We claim:

1. A system for changing the stiffness of a ski, said system comprising:

stiffening means extending in the longitudinal direction of the ski for imparting stiffness to the ski, said stiffening means having a high degree of immobility in response to bending movements of the ski in the horizontal longitudinal plane of the ski and being relatively movable in response to bending movements of the ski in the vertical longitudinal plane of the ski; and impedance means operatively engageable with the stiffening means, as bending movements are applied in the horizontal longitudinal plane of the ski.

2. The system of claim 1, wherein said stiffening means is comprised of a relatively rigid longitudinal member attachable to the ski.

3. The system of claim 2, wherein said longitudinal member is comprised of a first portion fixable to the ski and anchored to be non-rotatable about the vertical axis of the ski; and a second portion spaced apart from the first portion in the longitudinal direction of the ski, said second portion being movable in the longitudinal direction of the ski and being relatively immovable in the transverse direction of the ski.

4. The system of claim 3, wherein said second portion is connected to said first portion in a manner which allows the second portion to pivot about a transverse axis of the ski.

5. The system of claim 1, wherein said stiffening means is secured at three regions which are spaced apart from one another in the longitudinal direction of the ski, said stiffening means being relatively immovable in the transverse direction of the ski and being relatively movable in the longitudinal direction of the ski.

6. The system of claim 1, wherein said system further comprises abutment means fixed to said ski and operatively engageable with said stiffening means in the event of pronounced upward bending of at least one end of said ski in the vertical longitudinal plane, for transmitting shearing forces therebetween.

7. The system of claim 1, wherein said stiffening means is comprised of two longitudinal members having mutually facing ends which are movable in the longitudinal direction of the ski, and having ends opposite the mutually facing ends which are immovable in the longitudinal direction of the ski, said mutually facing ends transmitting shearing forces therebetween in the event of pronounced upward bending of at least one end of said ski in the vertical longitudinal plane.

8. The system of claim 1, wherein the stiffening means is at least partially resiliently secured in the transverse direction of said ski.

9. A system for controlling the longitudinal and horizontal stiffness in a ski, said system including:

longitudinal impedance means having one portion fixed to the ski and a second free portion which moves longitudinally relative to the ski when the ski bends longitudinally, and means for counteracting the movement of said second free portion to impart stiffness in the longitudinal direction; and transverse impedance means for imparting stiffness in the transverse direction relative to the ski.

10. A system according to claim 9 wherein said transverse impedance means has resistance means for enabling some movement of the ski in the transverse direction.

11. Apparatus for controlling the stiffness of a ski, said system comprising:

a rigid member securable to a ski, said rigid member having one portion being operatively fixable relative to the ski, another portion movable longitudinally as the ski bends in a vertical, longitudinal plane, and control means fixed relative to said rigid member;

guide means fixed relative to the ski for cooperating with said control means, said control means cooperating with said guide means for controlling the stiffness of the ski; and one of said control means and said guide means establishing a path of movement in the longitudinal direction and impeding a path of movement in a direction transverse to the longitudinal direction, and the other of said control means and said guide means following the path in the longitudinal direction.

12. Apparatus according to claim 11 wherein one of said control means and said guide means comprises a member with a longitudinally extending surface, and the other of said control means and said guide means comprises a member engaging said surface as the ski bends in the vertical, longitudinal plane.

13. Apparatus according to claim 12 wherein said surface are walls defining a slot.

14. Apparatus according to claim 11 wherein said rigid member comprises a pair of aligned rigid components, each component having one portion operatively fixable relative to the ski and a second portion movable longitudinally on the ski bends in a vertical, longitudinal plane, said second portions respectively supporting a toe piece and a heel piece of a ski binding;

said control means are fixed relative to each of said rigid components; and said guide means cooperate with said control means for controlling the stiffness of the ski.

15. Apparatus according to claim 11 wherein said guide means comprises holding means fixable relative to the ski, opposing wall means cooperating with said control means to define the longitudinal path, and wall support means attachable to the ski and having sloping sections movable in the longitudinal direction as the ski bends in the vertical, longitudinal plane to enable said control means and said guide means to continue their cooperative relationship.

16. Apparatus according to claim 11 wherein said rigid member comprises a pair of aligned plates extendable longitudinally on the ski, each plate having remote portions fixable relative to the ski and an opposed movable portion adjacent each other for moving towards each other in the longitudinal direction as the ski bends in the vertical, longitudinal plane until said adjacent ends abut, and said control means comprises control portions of each of said aligned plates, and said guide means is operatively engageable with said control portions to guide said aligned plates longitudinally along the ski as the ski bends in the vertical longitudinal plane.

17. Apparatus according to claim 11 wherein one of said control means and said guide means comprises opposing wall means cooperating to define the longitudinal path, said wall means being resilient in the transverse direction to yield if the other of said control means and said guide means exerts sufficient transverse force on said wall means, to enable movement of said guide means and the ski in a horizontal, longitudinal plane.

18. Apparatus according to claim 17 wherein said wall means are biased towards each other to provide the resiliency.

19. Apparatus according to claim 18 wherein the resiliency of said wall means varies as said control means moves in the vertical path between and relative to said wall means.

20. Apparatus for controlling the rigidity of a ski in a direction transverse to the longitudinal direction of the ski, the ski extending in a horizontal plane and extending in the longitudinal direction with the transverse direction being transverse to the longitudinal direction, said apparatus comprising:

plate means rigid relative to the ski and extending longitudinally on the ski, said plate means having at least one portion fixed relative to the ski and at least one other portion movable in the longitudinal direction as the ski bends in the vertical direction relative to said plate means;

control means attached to one of the ski and said plate means for controlling the stiffness of the ski; and guide means operatively attached to the other of the ski and said plate means for guiding said control means in the longitudinal direction when the ski bends vertically relative to said plate means and for restricting movement of said control means in a transverse direction to increase the rigidity of the ski in the transverse direction.

21. Apparatus according to claim 20 wherein said control means is pin means fixed to the ski.

22. Apparatus according to claim 20 wherein said guide means comprises a part having a slot extending in the longitudinal direction, and said control means comprises pin means extending into said slot for moving in the slot when the ski bends vertically relative to said plate means, and said slot restricts movement of said pin means in the transverse direction.

23. Apparatus according to claim 20 wherein said plate means comprises first plate means and second plate means, each of said first plate means and said second plate means having at least one portion fixed relative to the ski and at least one other portion pivotable about a transverse axis when the ski bends in the vertical direction relative to said first plate means and said second plate means;

wherein said control means comprises first and second control means attached to said first plate means and to said second plate means, respectively;

and wherein said guide means is in operative engagement with said first control means and said second control means for precluding the pivoting of said first plate means and said second plate means in the transverse direction.

24. Apparatus according to claim 20 and further including a heel part and a front jaw connected to said plate means between said portion fixed relative to the ski, for increasing the rigidity of the ski in the transverse direction.

25. Apparatus according to claim 20 wherein said plate means comprises first plate means and second plate means, each of said first plate means and said second plate means having free portions in a longitudinally spaced relationship when the ski is not bent in a vertical direction by more than a certain amount and which are operatively engaged when the ski bends in the vertical direction by a specific amount to impede further bending of the ski, and each of said first plate means and said second plate means having movable portions for pivoting around respective transverse axes and not pivoting around respective longitudinal axes, after said free portions of said first and second plate means are operatively engaged and the ski continues the bending in the vertical direction; and wherein said control means comprises first control means attached to said first plate means and second control means attached to said second plate means; and said guide means is attached to the ski and guides said first and second control means for movement in the longitudinal direction and precludes movement in the transverse direction.

26. Apparatus according to claim 20 wherein said plate means and said control means comprise a plate having a portion fixed relative to the ski and a portion movable longitudinally relative to the ski as the ski bends; and wherein said guide means comprises a guide member for guiding said plate for movement in the longitudinal direction but rendering said plate relatively immovable in the transverse direction.

27. Apparatus according to claim 20 wherein said control means comprises pin means fixed relative to the ski, and said guide means comprises a guide member attached to said plate means for guiding said pin means in the longitudinal direction when the ski bends vertically relative to said plate means.

28. Apparatus according to claim 27 wherein said plate means has sloping surfaces for accommodating and not hindering the bending of the ski in the vertical direction.

29. Apparatus according to claim 20 wherein said guide means comprises guide mouldings defining a channel for receiving said control means, said guide mouldings being resiliently secured in the transverse direction to control the yielding of said mouldings against the resiliency.

30. Apparatus according to claim 29 wherein said guide means further includes springs for providing spring force to supply the resiliency.

31. Apparatus according to claim 20 wherein the said spring force is adjustable.

32. Apparatus according to claim 30 wherein said springs are steel springs.

33. Apparatus according to claim 30 wherein said springs are plastic springs.

34. Apparatus according to claim 20 wherein said guide means comprises a pair of spring members defining a channel extending in the longitudinal direction, and said control means is movable in said channel as the ski bends in the vertical direction, wherein force exerted by the ski in a transverse direction is resisted by a resilient counterforce on said control means.

35. Apparatus according to claim 20 wherein said guide means comprises spring biased members defining a channel and said control means is movable in said channel, said channel extending in the longitudinal direction and being narrower at different parts of the channel to effect damping on said control means when the ski bends in the vertical direction.

36. Apparatus according to claim 20 and further including clamping means for clamping said guide means to the ski.

* * * * *